US008029031B2

(12) United States Patent
Hunt et al.

(10) Patent No.: US 8,029,031 B2
(45) **Date of Patent: *Oct. 4, 2011**

(54) POWER-ACTUATED MOTOR-VEHICLE DOOR LATCH

(75) Inventors: Robert Hunt, Davisburg, MI (US); Keith Julien, Canton, MI (US)

(73) Assignee: Keykert USA, Inc., Wixom, MI (US)

( * ) Notice: Subject to any disclaimer, the term of this patent is extended or adjusted under 35 U.S.C. 154(b) by 1017 days.

This patent is subject to a terminal disclaimer.

(21) Appl. No.: 11/903,205

(22) Filed: Sep. 20, 2007

(65) Prior Publication Data

US 2009/0079206 A1 Mar. 26, 2009

(51) Int. Cl.
*E05C 3/06* (2006.01)
*E05C 3/16* (2006.01)

(52) U.S. Cl. ..... 292/216; 292/201

(58) Field of Classification Search ..... 292/201, 292/216

See application file for complete search history.

(56) References Cited

U.S. PATENT DOCUMENTS 4,793,640 A * 12/1988 Stewart, Sr. ..... 292/201
5,154,457 A * 10/1992 Watanabe ..... 292/216
5,494,322 A * 2/1996 Menke ..... 292/216
5,634,677 A * 6/1997 Buscher et al. ..... 292/216
5,697,237 A * 12/1997 Dilger et al. ..... 70/264
6,148,651 A * 11/2000 Roncin ..... 70/264
6,338,508 B1 * 1/2002 Kleefeldt ..... 292/201
6,568,722 B2 * 5/2003 Raffelsiefer et al. ..... 292/216
6,712,407 B2 * 3/2004 Duriez ..... 292/201
6,737,758 B2 5/2004 Weyerstall
7,140,651 B2 * 11/2006 Brose ..... 292/216
7,261,333 B2 * 8/2007 Tomaszewski ..... 292/201
7,399,010 B2 * 7/2008 Hunt et al. ..... 292/201
2004/0094971 A1 * 5/2004 Warmke et al. ..... 292/201
2007/0158954 A1 * 7/2007 Warmke et al. ..... 292/201

FOREIGN PATENT DOCUMENTS

DE 10247842 A 3/2004
EP 1 288 408 5/2003

* cited by examiner

*Primary Examiner* — Carlos Lugo
(74) *Attorney, Agent, or Firm* — Andrew Wilford

(57) ABSTRACT

A motor-vehicle door latch has a housing, a latch mechanism in the housing operable to unlock a vehicle door, and an actuating element. A linkage in the housing is engageable between the actuating element and the latch mechanism and shiftable between a coupled position for operation of the latch mechanism by the actuating element and a decoupled position operatively disconnecting the actuating element from the latch mechanism. A blocking element connected to the linkage is operable to shift the linkage between its coupled and decoupled positions. A drive motor operates the blocking element. A quick-unlock element bears via the blocking element on the linkage.

9 Claims, 8 Drawing Sheets

POWER-ACTUATED MOTOR-VEHICLE DOOR LATCH

CROSS REFERENCE TO RELATED APPLICATION

This application is related to copending U.S. patent application Ser. No. 11/525,227 files 21 Sep. 2006, the entire disclosure of which is herewith incorporated by reference.

FIELD OF THE INVENTION

The invention relates to a motor-vehicle door latch having latch parts including at least one locking lever, at least one motor drive, a linkage between an actuating-lever assembly and the latch mechanism, and with a quick-unlock element connected with the drive.

BACKGROUND OF THE INVENTION

In motor-vehicle door latches of this type, typically the motor drive moves the locking lever, which is normally configured as a central locking lever, into locked or unlocked positions. Furthermore, in principle also further positions of the locking lever can be achieved, for example such as the so-called antitheft position.

The unlocking process is generally performed with a keyless entry systems. With such a system the user carries an identification device (for example a code card) that initiates a dialog with a control system provided in the vehicle when the vehicle user approaches the vehicle or actuates the outside door actuating element (the door handle). During the course of this dialog, access authorization of the vehicle user seeking access is verified. Once the authorization has been verified, the control system sends a signal to at least one or all of the door latches of the motor vehicle. Then, the motor-vehicle door latch is unlocked with the help of its drive and can then be opened mechanically, for example with the help of the outside door handle.

The problem with this is that an authorized vehicle user seeking access has often already operated the outside door handle while the dialog is still in process or before the associated motor-vehicle door latch has assumed the unlocked position. The reason for this is that the above-mentioned keyless entry systems require a certain response time to carry out the unlocking operation. This response time includes an activation interval in order to activate the system as the vehicle user approaches, an authorization verification interval and finally the actual actuation interval.

In practice, response times of about 100 msec or more are known, which are perceived by the vehicle users as too long compared to conventional motor-vehicle door latch systems. Furthermore, it is possible that the vehicle user has already operated the outside door handle in an attempt to open it before the associated motor-vehicle door latch has assumed the unlocked position. The vehicle user then has to release the outside door handle and perform another confirmation step, which is considered a clear limitation in terms of convenience.

For this reason, quick-unlock systems have been developed that use quick-unlock elements. They all share the basic principle of bridging or shortening the comparatively long unlocking cycle of the locking lever and/or central locking lever in that the quick-unlock element allows the mechanical opening of the associated motor-vehicle door latch practically immediately following actuation of the drive.

In particular, German 102 47 842 provides that shifting of the central locking arrangement from the locked to the unlocked state initially moves the linkage and/or linkage arrangement from the locked into the unlocked state and thereafter moves the inside locking element from the locked to the unlocked state. For this purpose, a quick-unlock lever is provided, the locking lever and the quick-unlock lever being moved to the unlocked and locked states by means of the drive. The quick-unlock lever is connected to the linkage arrangement, specifically via a link rod.

The known configuration has proven useful in principle, however it has an overall uninviting design because the quick-unlock lever is mounted on the locking lever and/or both pivot about the same axis. In addition a custom locking lever is needed for the quick-unlock function.

A similar system is seen in EP 1 288 408. This system offers a further development in that the quick-unlock lever releases the latch mechanism during the course of the quick-unlock operation with the help of the drive, substantially independently of the position of the locking lever. The quick-unlock lever is configured as a one-arm lever that is pivoted on the locking lever.

In the system of EP 1,283,934 [U.S. Pat. No. 6,737,758], the quick-unlock element can be connected to the lock mechanism and/or a locking element in a more or less integral manner. In an alternative system, the quick-unlock element can be configured as a spring-loaded snap-action element that is released by the drive and snaps into its actuation position under spring force.

A motor vehicle door lock of the kind described above is the subject matter of EP 1 283 934 B1. Here, the quick-unlock element is associated with the central locking drive. In particular, the quick-unlock element is configured as a spring a spring-loaded snap-action element that is only released by the central locking drive and then snaps into its actuating position under spring force. This design is relatively complex because the lock mechanism and the central locking drive are separate units.

OBJECT OF THE INVENTION

It is the object of the invention to further develop such a motor-vehicle door latch that a compact configuration is achieved with flawless functionality.

SUMMARY OF THE INVENTION

In order to solve this technical problem, a standard motor-vehicle door latch is characterized in that the quick-unlock element operates the linkage by means of a blocking element.

In the scope of the invention, it is hence essential that an additional blocking element be provided that ensures a mechanical connection between the quick-unlock element and the linkage. In fact, the blocking element in question can serve to set at least the coupled and uncoupled positions of the linkage. In the coupled position, the linkage—as is common for motor-vehicle door latches—establishes an uninterrupted mechanical connection between the actuating-lever assembly and the locking mechanism such that the locking mechanism can be opened, for example, with an outside actuating lever of the actuating-lever assembly.

If, however, the linkage is in the uncoupled position, an actuation of the outside actuating lever or of an inside actuating lever of the actuating-lever assembly forces the actuating-lever assembly to perform a no-load stroke so that the locking mechanism cannot be opened. The continuous mechanical connection from the respective actuating lever to the locking mechanism is therefore interrupted in the uncoupled position of the linkage.

The blocking element, which in turn actuates the linkage, is operated with the help of the quick-unlock element associated with the drive. This is what happens for quick-unlock. This quick-unlock process—as mentioned at the beginning—is performed practically independently of the actual unlocking process via the locking lever or central locking lever and therefore requires considerably less time.

More particularly, the quick-unlock element is mounted on the drive and actuated by it. In practice the quick-unlock element is pivotal by the motor drive in two opposite angular directions relative to the blocking element. If the motor drive—beginning in the locked position of the motor-vehicle door latch and consequently with the linkage in the uncoupled position—is moved in the unlocking direction, the quick-unlock element, which is generally mounted on a control gear of the drive, ensures that the blocking element is operated after only a brief travel of the drive. As a result, the blocking element is pivoted and the linkage leaves the original uncoupled position and switches (usually under spring force) directly to the coupled position. This coupled position of the linkage then ensures that the actuating-lever assembly has a direct mechanical connection to the locking mechanism and that the locking mechanism can be opened.

To achieve this, in particular, the quick-unlock element is provided with at least one tab that cooperates with an abutment arm on the blocking element for quick-unlock. As soon as the tab moves to or against the abutment arm, the blocking element is lifted off the linkage so that the linkage is urged by a spring into the coupled position.

In general, the tab operates the abutment arm in question on the blocking element only in one rotational direction of the quick-unlock element and consequently only in one pivot direction of the motor drive. In contrast, an actuation of the quick-unlock element in the opposite direction remains without effect, which is to say that the blocking element is not raised. This function corresponds to that of a ratchet, so that the quick-unlock element is advantageously configured as a ratchet cooperating with the blocking element.

In general, the quick-unlock element that is pivotal about the same axis as the control gear of the drive, is integrated into the control gear in question. In principle, however, the quick-unlock element can also be mounted on the control gear. Usually, the quick-unlock element is provided underneath or inside the control gear configured cup-shaped, specifically immediately adjacent a transmission lever. This transmission lever is connected to the locking lever.

In general, the blocking element bears on the linkage so that the linkage follows the movements of the blocking element, which is in turn pivoted with the help of the transmission lever connected to the locking lever. This situation only changes when the quick-unlock operation is performed. In a quick-unlock operation, the blocking element moves out of contact with the linkage. Since the linkage is spring prestressed into the coupled position, the linkage is then moved by a spring into the coupled position. To ensure that the blocking element bears directly against the linkage, the element is generally spring prestressed by a spring in the direction of contact. The spring in question can be mounted on the transmission lever or directly on the blocking element.

Consequently, a motor-vehicle door latch is provided that is first of all distinguished by a particularly compact design. This is due to the fact that the quick-unlock element is associated with the drive or central locking drive and advantageously integrated therein. In fact, in most cases the quick-unlock element is provided inside the control gear of the drive, the gear being cup-shaped. In addition, the quick-unlock element is generally configured as a compact ratchet.

The blocking element actuated by the quick-unlock element is mounted in the same or in a parallel plane with the quick-unlock element and consequently relative to the control gear of the drive. Also the transmission lever and the locking lever are provided in the same plane or parallel thereto. Only the linkage is offset by approximately 90° by comparison. As a result, the quick-unlock element and the blocking element cooperating therewith execute substantially pivotal movements in the same plane as the locking lever and the motor drive.

This pivoting of the quick-unlock element or the blocking element is transmitted to the linkage extending substantially perpendicularly, the linkage being located in the same plane as the locking mechanism or parallel thereto. This is possible without difficulty because the linkage is spring prestressed into the coupled position and the blocking element operates on a pin on the linkage.

During transition from the unlocked to the locked position and back (with the exception of the quick-unlock operation), the blocking element rests with its lever end opposite the axis of rotation on the respective pin of the linkage. The respective lever end only leaves the pin during the quick-unlock operation, so that the linkage can directly assume the coupled position due to the spring pre-tension. As a result, the actuating-lever assembly can directly open the locking mechanism. These are the most important advantages.

BRIEF DESCRIPTION OF THE DRAWING

The invention will be explained in more detail hereinafter with reference to one embodiment that is shown in the drawing where.

SPECIFIC DESCRIPTION

Figure 1:
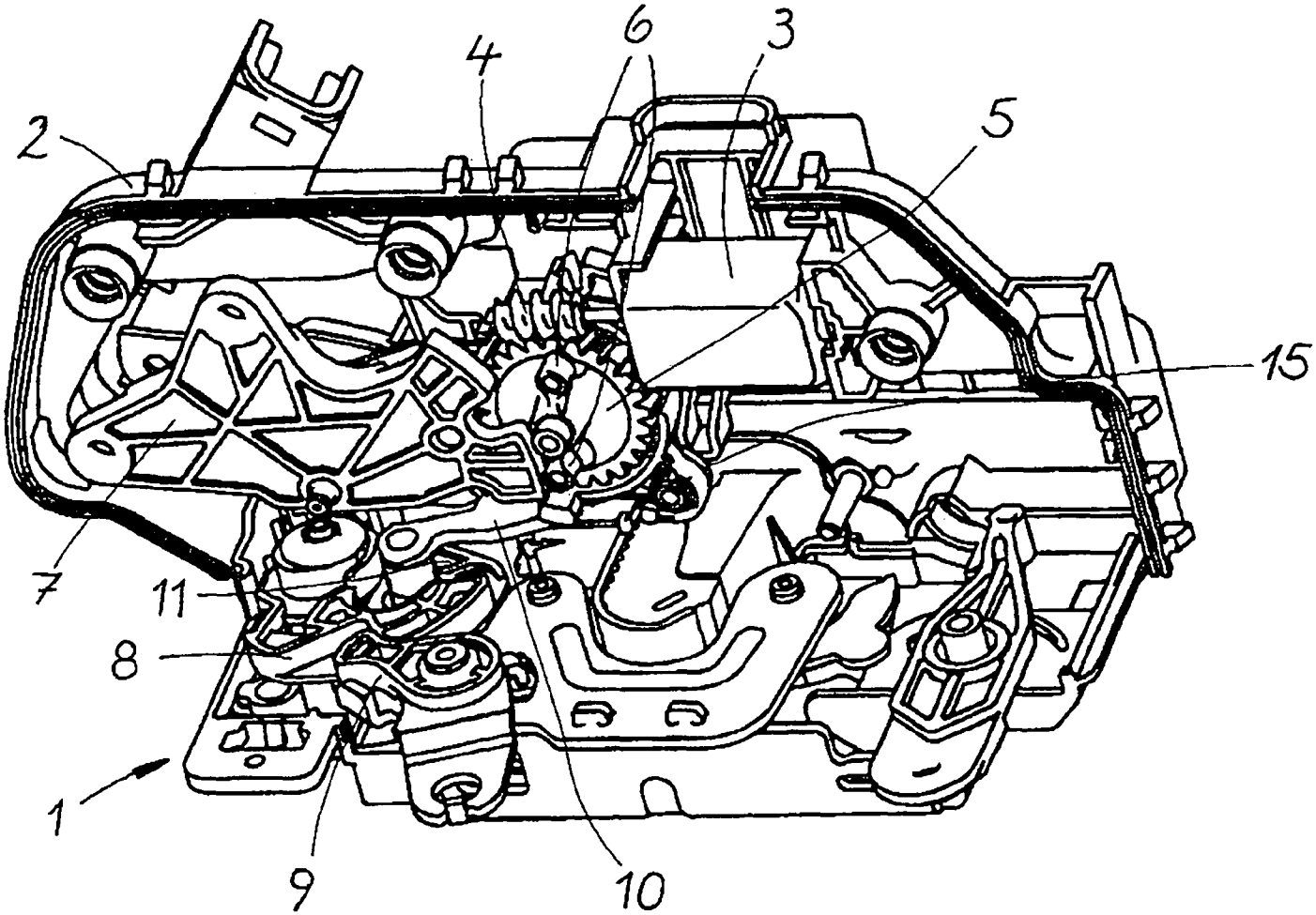
FIG. 1 shows an overview of the motor-vehicle door latch according to the invention.

FIG. 1 shows a motor-vehicle door latch according to the invention in its basic configuration. The lock plate 1 as well as a lock housing 2 projecting crosswise therefrom are shown, the housing holding a motor drive 3, 4, 5, 6. The motor drive 3, 4, 5, 6 comprises an electric motor 3, a drive worm gear 4, a control gear 5 as well as two actuating pins 6 mounted on the control gear 5. The control gear 5 is mounted in the lock housing 2. This also applies to a locking lever 7 that in the present non-limiting embodiment is configured as a central locking lever 7.

Figure 5:
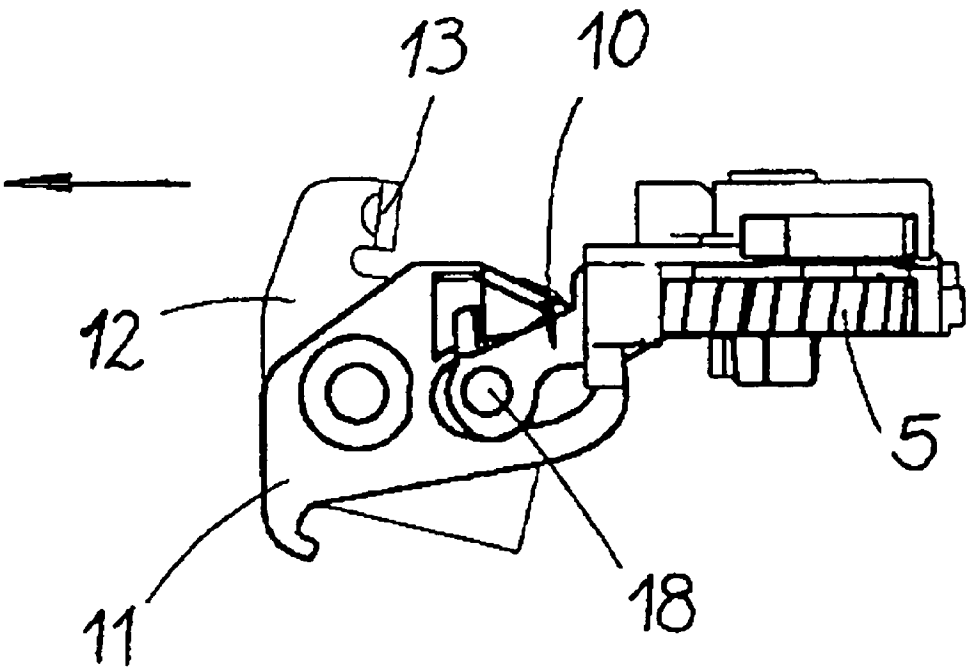

The motor-vehicle door latch also includes a locking mechanism 8, 9 that comprises a rotary latch fork 8 and a retaining pawl 9 interacting therewith. The locking mechanism 8, 9, that is the rotary latch fork 8 and the retaining pawl 9, is mounted on the lock plate 1. Furthermore, a linkage 10, 11, 12 is also shown that is provided between an actuating-lever assembly 13 and the locking mechanism 8, 9 (see FIG. 5). Finally, a quick-unlock element 14 and a blocking element 15 are part of the basic configuration.

Figure 3A:
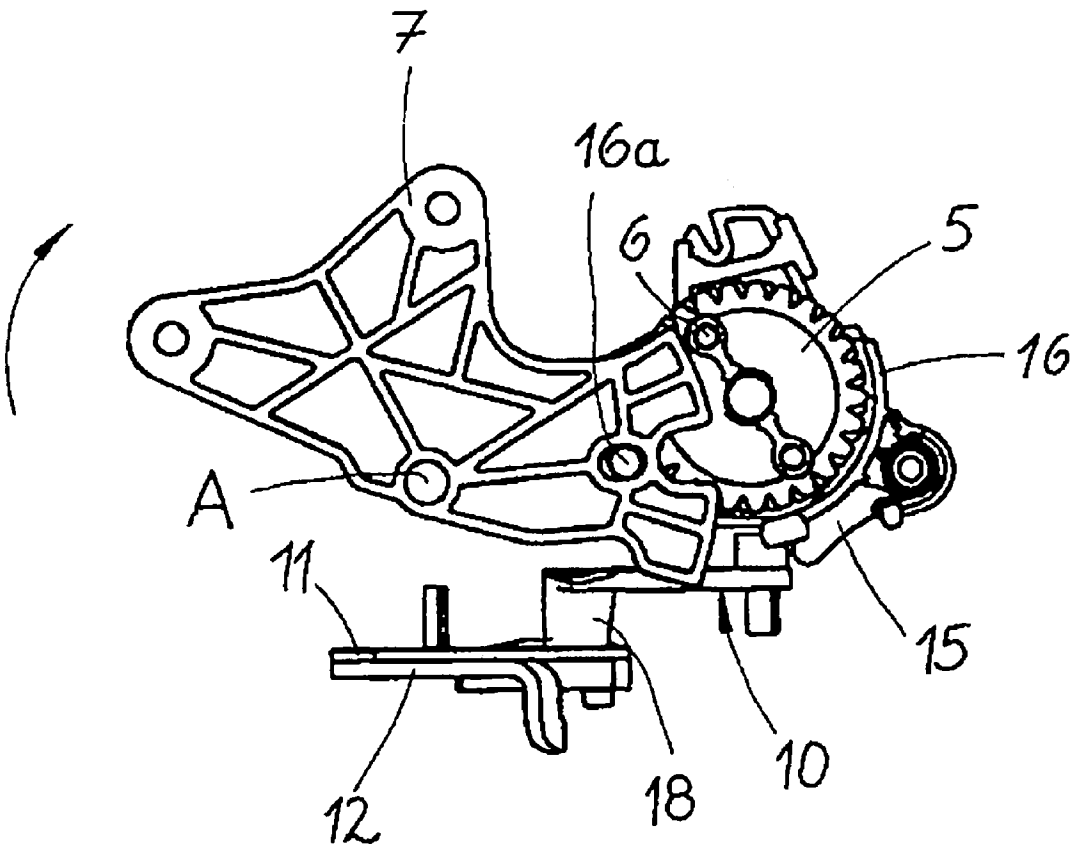
FIGS. 3*a* to 3*c* show the drive and the lock in various functional positions.
Figure 3B:
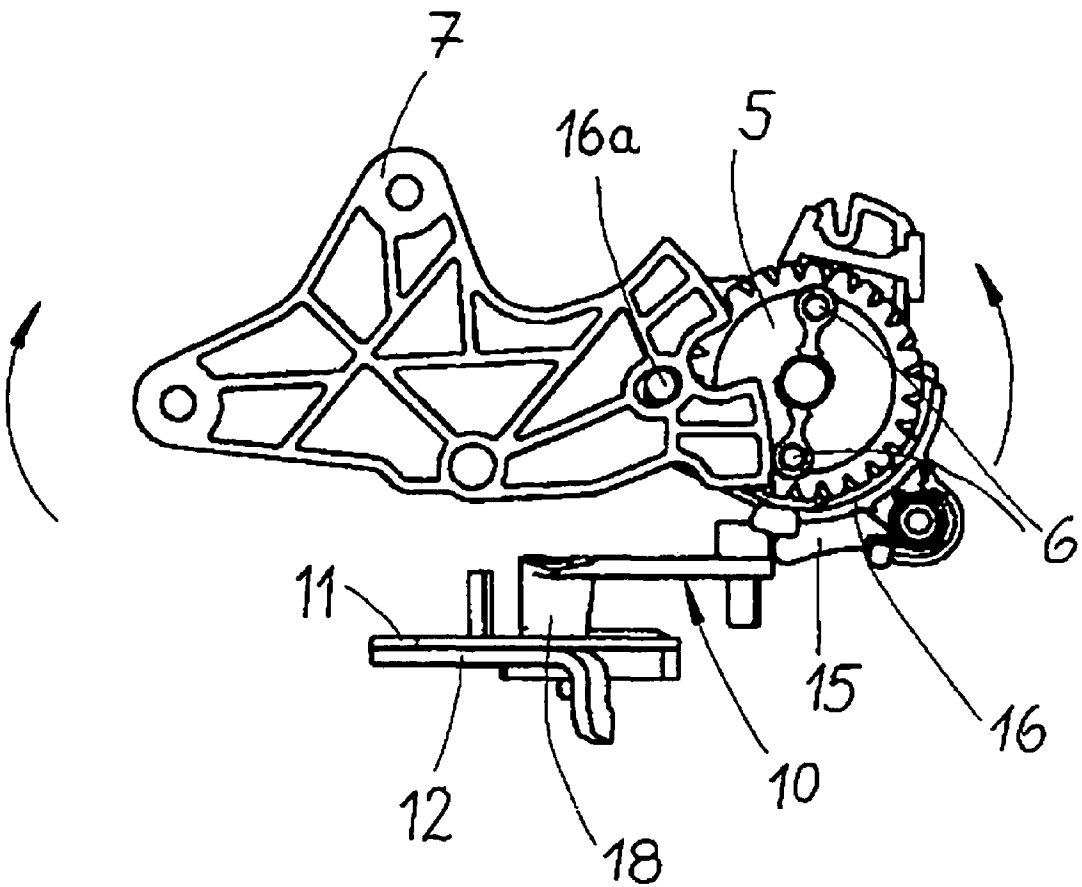
Figure 3C:
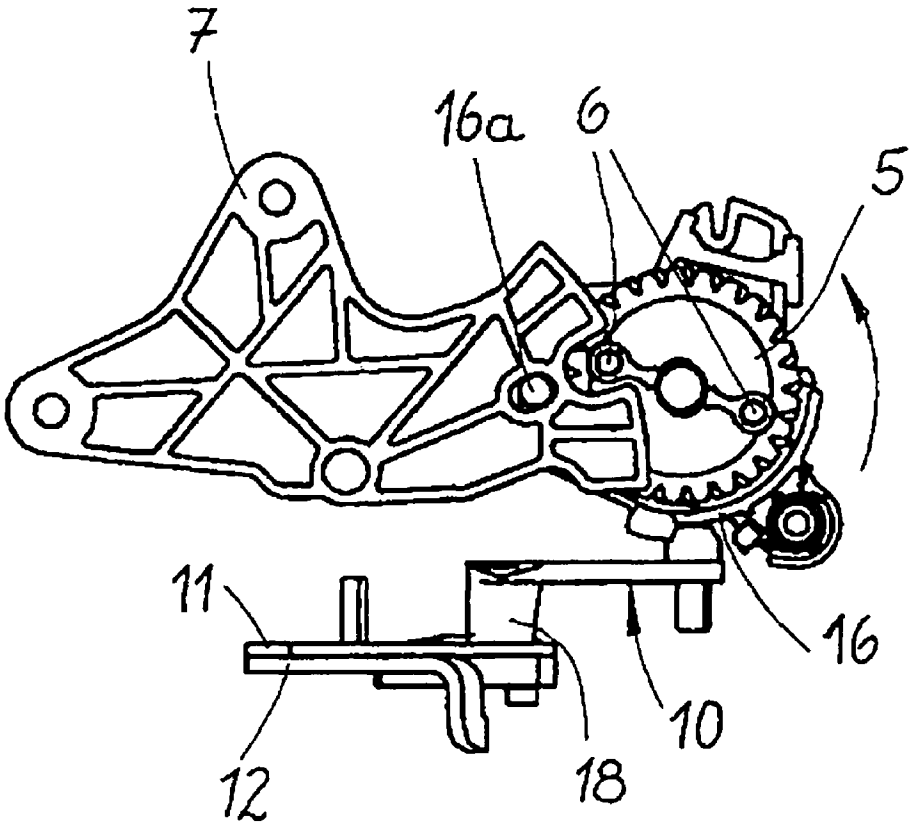
Figure 4:
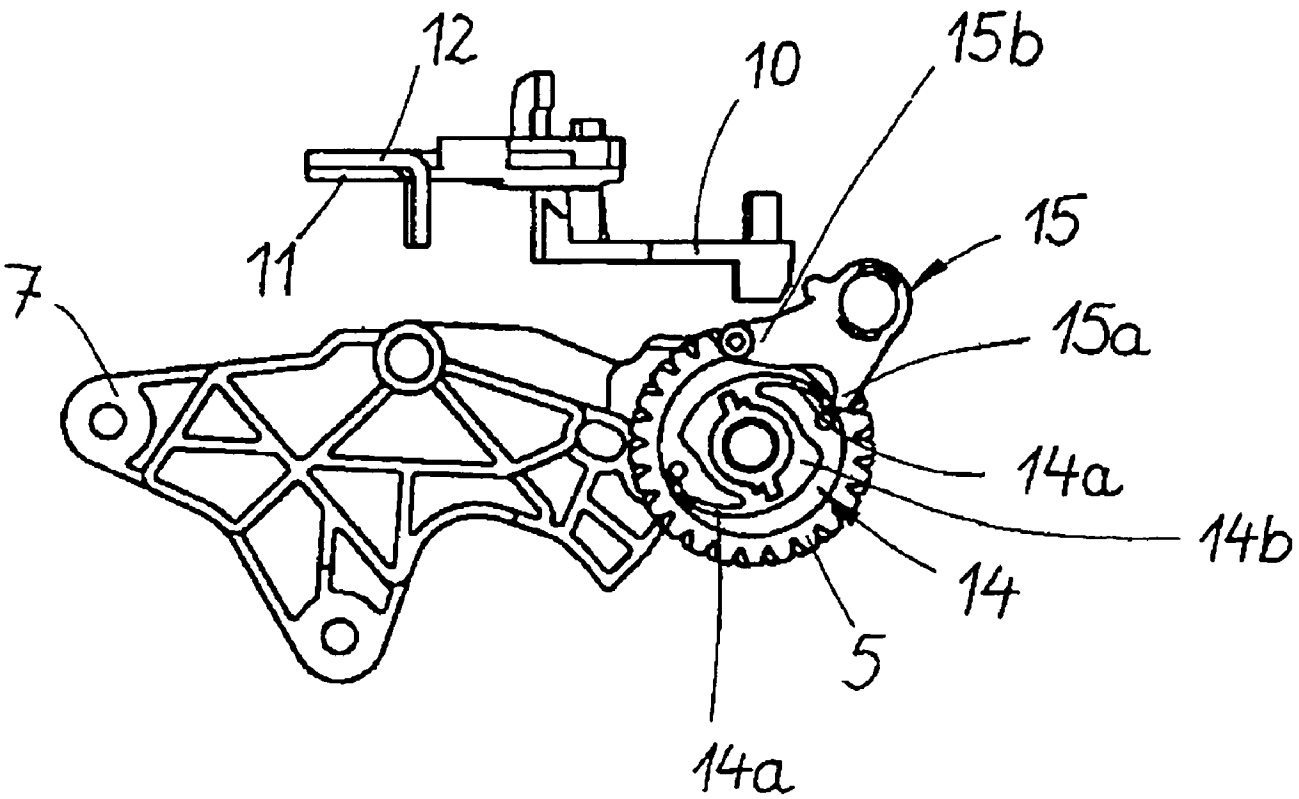
FIGS. 4 and 5 are further different views.
Figure 6:
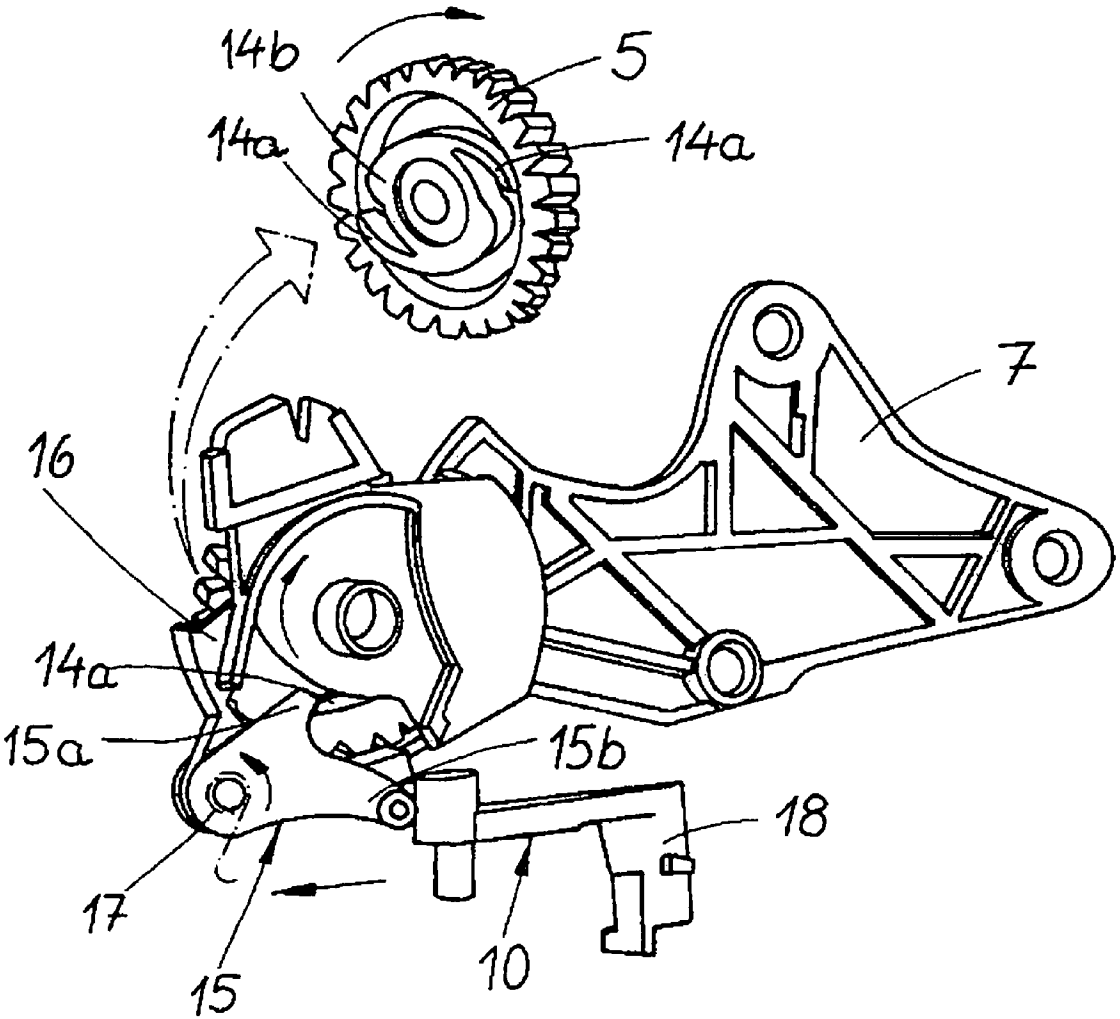
FIG. 6 shows the drive and the lock in perspective views and in part in individual views.

In particular FIGS. 4 and 6 show that the quick-unlock element 14 is associated with the drive 3, 4, 5, 6 and is mounted on and actuated by the drive 3, 4, 5, 6. This is achieved by the invention in particular in that the quick-unlock element 14 is pivotal about the same axis as the control gear 5 of the drive 3, 4, 5, 6. FIG. 6 shows in particular that the control gear 5 is configured as a cup and the quick-unlock element 14 is mounted inside it, specifically on the same axle as the control gear 5. In addition, the quick-unlock element 14 is provided immediately adjacent a transmission lever 16 that according to FIG. 6 is connected to the locking lever 7. To this end, the transmission lever 16 carries a pin 16*a* that engages through a hole in the locking lever 7 as best seen in FIGS. 3*a* to 3*c*.

In the illustrated embodiment, the quick-unlock element 14 is provided with two tabs 14*a*. In fact, the two tabs 14*a* are provided substantially diametrally opposite each other relative to the axis of rotation shared with the control gear 5. In addition, the two tabs 14*a* are provided on or form extensions from a hub 14*b* of the quick-unlock element 14 that is mounted on a shaft of the control gear 5 (see FIG. 4).

The one or two tabs 14*a* of the quick-unlock element 14 interact with an abutment arm 15*a* on the blocking element 15 for quick-unlock purposes. In addition to the abutment arm 15*a*, the blocking element 15 is also provided with a blocking arm 15*b* that interacts with a link 10 of the linkage 10, 11, 12 as will be described in more detail hereinafter. As a result of the abutment arm 15*a* and the blocking arm 15*b*, the blocking element 15 is a two-arm lever that is mounted on the transmission lever 16 and consequently moves together with it and the locking lever 7 as well as the drive 3, 4, 5, 6 (when not performing the quick-unlock function), as a comparison of FIGS. 3*a* and 3*b* shows.

The quick-unlock element 14 is formed as a ratchet 14 cooperating with the blocking element 15. The tab 14*a* of the quick-unlock element 14 is only effective on the abutment arm 15*a* of the blocking element 15 only in one angular direction of the quick-unlock element 14 that in FIG. 6 is indicated by the arrows. This angular direction of the quick-unlock element 14 in FIG. 6 in fact corresponds to clockwise rotation. Only such rotation allows the tab 14*a* to operate the abutment arm 15*a* of the blocking element 15 such that the blocking element 15, as indicated, pivots counter-clockwise about its axis on the transmission lever 16.

As a result, the blocking arm 15*b* of the blocking element 15 is raised from a position bearing on the link 10 of the linkage 10, 11, 12, which otherwise is its rest position. A spring then shifts the link 10 from the uncoupled position shown on the left in FIG. 6 into the coupled position. As a result, the actuating-lever assembly 13 is directly mechanically connected to the locking mechanism 8, 9 and can open it.

In the opposite direction, that is on counter-clockwise actuation of the quick-unlock element 14 according to FIG. 6, the tab 14*a* of the quick-unlock element 14, since the abutment arm is spring-mounted on the hub 14*b*, slides past the abutment arm 15*a* of the blocking element 15 without actuating the blocking element 15. This way, the blocking arm 15*b* of the blocking element 15 stays in a position resting against the link 10 that therefore remains in the uncoupled position.

The blocking element 15 is rotationally prestressed by a spring 17 in the direction of engagement with the linkage 10, 11, 12 or the link 10, the spring being only indicated in FIG. 6 and mounted on the transmission lever 16. In principle, the spring 17 can be installed or mounted alternatively or additionally on the blocking element 15. Either way, during the quick-unlock operation—and only then—the blocking element 15 is separated from the linkage 10, 11, 12 or the link 10 that then moves, supported by the force of the spring, into the coupled position of the linkage 10, 11, 12.

The linkage 10, 11, 12 comprises the above-mentioned link 10 and two further links 11, 12. The link 10 carries at its outer end a pin 18 that fits in the hole in the link 11 and that the link 12 in the position according to FIG. 5 can interlock. The linkage 10, 11, 12 is then in the coupled position, and movements are transmitted in accordance with the direction of the arrows by the actuating-lever assembly 13 from the link 12 to the link 11 that in turn lifts out the locking mechanism 6, 9.

If, however, the linkage 10, 11, 12 is in the uncoupled position, the link 10 assumes a different end position in the hole in the link 11. In this position, the link 12 can no longer engage the pin 18 of the link 10. As a result, movement of the link 12 is ineffective and is not transmitted to the link 11. The locking mechanism 8, 9 is therefore not affected.

Figure 2:
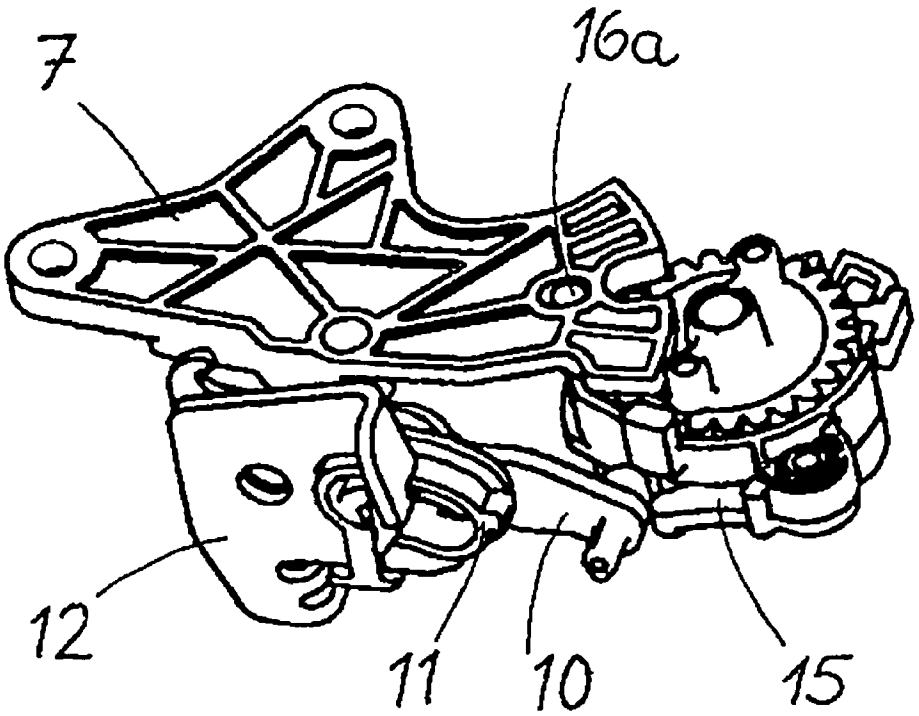
FIG. 2 shows details of FIG. 1, namely the drive including the lock.

The operating principle is as follows. In FIGS. 2 and 3, the motor-vehicle door latch is in the locked position. The drive 3, 4, 5, 6 is blocked or bearing on an abutment because the one actuating pin 6 at the top rests against or bears on the locking lever or central locking lever. In fact, two blocking surfaces are provided on opposite ends of an actuating slot of the locking lever 7, as is very common for implementing the central locking function and described in particular, for example, in U.S. Pat. No. 6,338,508.

So as to switch the motor-vehicle door latch from the locked position according to FIGS. 2 and 3*b* into the unlocked position according to FIG. 3*a*, the drive 3, 4, 5, 6 is operated such that the control gear 5—starting from the position of FIG. 3*b*-performs approximately a 180° counter-clockwise rotation, as the arrow there indicates. The actuating pin 6 on the left in FIG. 3*b* engages the seat or actuating seat in the locking lever 7, so that the locking lever 7 during transition to the FIG. 3*a* position pivots clockwise about the axis A.

Since the transmission lever 16 is coupled to the locking lever 7 via the pin 16*a*, the clockwise pivoting of the locking lever 7 pivots the transmission lever 16 counter-clockwise. Since the blocking element 15 is mounted on this transmission lever 16, it follows this pivoting. As a result, the link 10, which continues to bear on the blocking arm 15*b* of the blocking element 15, compared to its position according to FIG. 3*b* moves downward during the transition according to FIG. 3*a* and assumes the coupled position in the unlocked position according to FIG. 3*a*, as is shown for the linkage 10, 11, 12 in FIG. 5. Then, the locking mechanism 8, 9 can be opened via the actuating-lever assembly 13 because a continuous mechanical connection exists.

During the quick-unlock operation, the motor-vehicle door latch is likewise initially in the locked position according to FIG. 3*b*. If the drive 3, 4, 5, 6—as is indicated in FIG. 3*b*—is operated such that the control gear 5 performs a slight counter-clockwise rotational movement of less than a quarter rotation, this rotational movement according to FIGS. 4 and 6 ensures that the tab 14*a* of the quick-unlock element 14 engages with the abutment arm 15*a* of the blocking element 15 so that the blocking element 15 is raised off the link 10, as described. The link 10 is released by the blocking arm 15*b* and the linkage 10, 11, 12, as a result of the spring force, shifts into the coupled or quick-unlocked position according to FIG. 3*c*. The locking mechanism 8, 9 can then be opened directly with the help of the actuating-lever assembly 13.

If the control gear 5—starting from the position according to FIG. 3*c*—is moved further counter-clockwise, the locking lever 7 and the transmission lever 16 follow this movement until in the end the position according to FIG. 3*a* has been reached. The blocking element 15 pivots back into the position according to FIG. 6 or the one according to FIG. 3*a* as soon as the tab 14*a* of the quick-unlock element 14 no longer engages the abutment arm 15*a* on the blocking element 15. Since during this further movement of the control gear 5 the blocking element 15, due to the similarly moving transmission lever 16, follows the movement, the blocking arm 15*b* of the blocking element 15—at the end of this movement and in the unlocked position according to FIG. 3*a*—can again pivot to bear against the link 10 (with spring biasing).

The link 10 thus remains in the coupled position, in fact until the motor-vehicle door latch is (again) locked. To this end, the drive 3, 4, 5—starting from the position according to FIG. 3*a*—is operated in the clockwise direction and the right-hand actuating pin 6 engages the actuating hole of the locking lever 7 and pivots it counter-clockwise until it reaches the position pf FIG. 3*b* and the formerly left-hand actuating pin 6 comes into engagement with the blocking surface according to FIG. 3*b*, and consequently the drive 3, 4, 5, 6 is stopped. At the same time, the transmission lever 16, and along with it the blocking element 15, follow this movement. This also applies to the link 10 that is pulled back from the position according to FIG. 3*a* and is consequently uncoupled. The linkage 10, 11, 12 now in the uncoupled position no longer forms a mechanical connection between the actuating-lever assembly 13 and the locking mechanism 8, 9 so that operation of the actuating-lever assembly 13 is ineffective.

The invention claimed is:

1. A motor-vehicle door latch comprising:

a housing;

a lock plate fixed to the housing;

a latch mechanism on the lock plate operable to unlock and lock a vehicle door;

an actuating element;

means in the housing including a linkage engageable between the actuating element and the latch mechanism and shiftable between a coupled position for operation of the latch mechanism by the actuating element and a decoupled position operatively disconnecting the actuating element from the latch mechanism;

a blocking element connected to the linkage and operable to shift the linkage between its coupled and decoupled positions;

drive means including a drive motor and a drive mechanism coupled between the drive motor and the blocking element for operating the blocking element; and a quick-unlock element pivoted on and actuated by the drive mechanism and bearing via the blocking element on the linkage and operable in a specific event to quickly shift the linkage via the blocking element into the coupled position.

2. The motor-vehicle door latch defined in claim 1, further comprising a spring biasing the linkage into the coupled position.

3. The motor-vehicle door latch defined in claim 1, further comprising a spring urging the blocking element into engagement with the linkage.

4. The motor-vehicle door latch defined in claim 3 wherein the spring is a torque spring carried on a pivot of the blocking element.

5. The motor-vehicle door latch defined in claim 3 wherein the blocking element disengages from the quick-unlock element on operation thereof, whereby the spring returns the blocking element to engagement with the linkage.

6. A motor-vehicle door latch comprising:

a housing;

a lock plate fixed to the housing;

a latch mechanism on the lock plate operable to unlock and lock a vehicle door;

an actuating element;

means in the housing including a linkage engageable between the actuating element and the latch mechanism and shiftable between a coupled position for operation of the latch mechanism by the actuating element and a decoupled position operatively disconnecting the actuating element from the latch mechanism;

a blocking element connected to the linkage and operable to shift the linkage between its coupled and decoupled positions;

drive means including a drive motor coupled to the blocking element for operating the blocking element, and a gear wheel rotatable about an axis and a quick-unlock element and also pivotal about the axis; and the quick-unlock element bearing via the blocking element on the linkage and operable in a specific event to quickly shift the linkage via the blocking element into the coupled position.

7. The motor-vehicle door latch defined in claim 6 wherein the quick-unlock element has an actuating tab engageable with an abutment of the blocking element.

8. The motor-vehicle door latch defined in claim 7 wherein the tab is on the gear wheel and is only operatively engageable with the quick-unlock element in one rotational direction of the wheel about the axis.

9. The motor-vehicle door latch defined in claim 7 wherein the gear wheel is cup-shaped and the tab is inside the gear wheel.

* * * * *